United States Patent [19]

Leather et al.

[11] Patent Number: 4,885,797

[45] Date of Patent: Dec. 5, 1989

[54] COMMUNICATION SYSTEM

[75] Inventors: Terence H. Leather; Frank R. Naylor, both of Blackpool; Paul S. Gradwell, Chorley, all of United Kingdom

[73] Assignee: Terence H. Leather, Blackpool, England

[21] Appl. No.: 199,277

[22] PCT Filed: Dec. 15, 1986

[86] PCT No.: PCT/GB86/00762

§ 371 Date: Jun. 2, 1988

§ 102(e) Date: Jun. 2, 1988

[87] PCT Pub. No.: WO87/03501

PCT Pub. Date: Jun. 18, 1987

[30] Foreign Application Priority Data

Dec. 13, 1985 [GB] United Kingdom ..... 8530772

[51] Int. Cl.[4] ..... H04B 1/34

[52] U.S. Cl. ..... 455/40; 455/66; 455/100; 455/351; 340/323 R

[58] Field of Search ..... 455/39–41, 455/66, 67, 68, 89, 90, 100, 344, 95, 347, 350, 351; 340/323 R; 381/187, 188, 79

[56] References Cited

U.S. PATENT DOCUMENTS

| | | | |
|---|---|---|---|
| 3,492,582 | 3/1967 | Heywood | 455/39 |
| 3,810,019 | 5/1974 | Miller | 455/40 |
| 4,173,016 | 10/1979 | Dickson | 455/89 |
| 4,225,970 | 9/1980 | Jaramilla et al. | 455/89 |
| 4,340,972 | 7/1982 | Heist | 455/39 |
| 4,536,739 | 8/1985 | Nobuta | 455/66 |
| 4,648,130 | 3/1987 | Kuznetz | 455/100 |
| 4,673,893 | 6/1987 | Shorkey | 340/323 R |
| 4,677,657 | 6/1987 | Nagata et al. | 455/89 |
| 4,682,363 | 7/1987 | Goldfarb et al. | 455/89 |
| 4,696,054 | 9/1987 | Tsugei et al. | 455/89 |

FOREIGN PATENT DOCUMENTS

| | | |
|---|---|---|
| 1184252 | 12/1964 | Fed. Rep. of Germany . |
| 2221767 | 11/1973 | Fed. Rep. of Germany . |
| 2817195 | 10/1979 | Fed. Rep. of Germany . |

*Primary Examiner*—Robert L. Griffin
*Assistant Examiner*—Curtis Kuntz
*Attorney, Agent, or Firm*—Scrivener and Clarke

[57] ABSTRACT

An audio signal and a selected one of a plurality of sub-audio tones are transmitted to a plurality of receiving each being capable of being conditioned by first, second or third selected sub-audio tones so that either all receivers, or only a select group of all of the receivers or only an intended group are the receivers accept the transmitted audio signal, there being as many selectable second sub-audio signals as there are groups and as many selectable third sub-audio signals as there are receivers.

3 Claims, 5 Drawing Sheets

Fig. 3
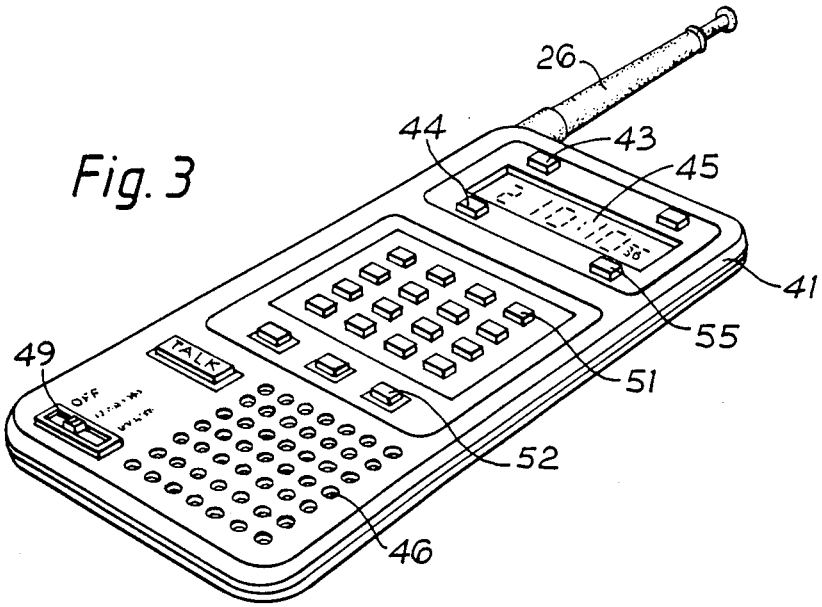
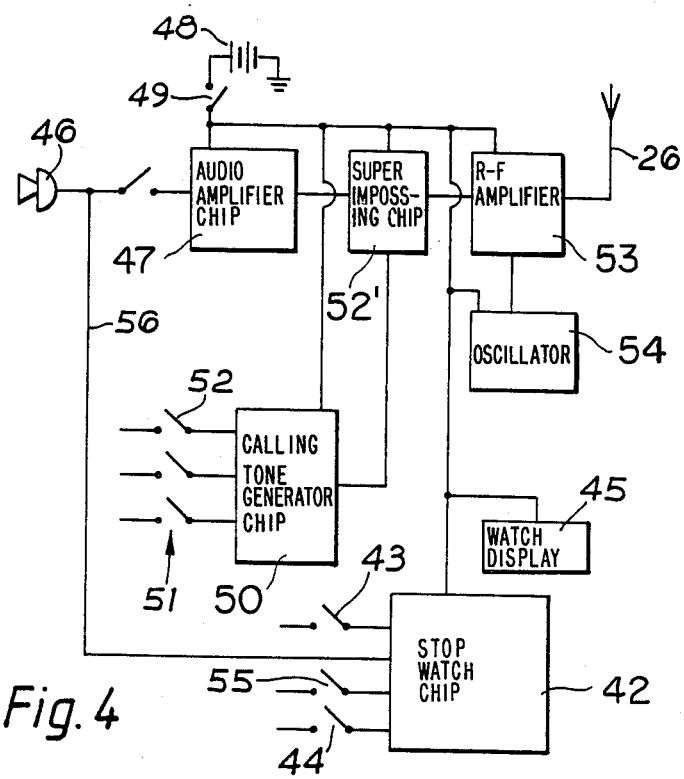
Fig. 4

COMMUNICATION SYSTEM

FIELD OF THE INVENTION

The present invention relates to communication systems.

BACKGROUND OF THE INVENTION

The invention arose from a problem in coaching swimmers. A swimming coach watches his swimmers from a pool surround and yells his instructions. Swimming pools especially when indoors are noisy places and it is difficult for any swimmer to understand the shouted instructions. Normally there are many swimmers being coached at the same time and thus each swimmer has to listen for any instruction which might be meant for him and ignore instructions meant for any one else; this is distracting to the swimmer.

The invention is not however limited to swimming instruction but is applicable to most sports and other communication.

The present invention aims to provide a communication system for the transmission of instructions from an instructor to a class or other group of instructees.

SUMMARY OF THE PRESENT INVENTION

One aspect of the present invention provides a communication system comprising an instruction unit linked electro-magnetically to a receiving unit in something to be worn by an instructee.

The electro-magnetic linking can be done at audio frequency by having a loop surrounding the class or group or by radio transmission. If radio transmission is used, the transmitter should be of low power say 1 watt of radiated power to avoid too large an area in which the signal can be received.

The system can incorporate an encryption or scrambling device to prevent outsiders eavesdropping on the instructions given. There is keen rivalry between swimming coaches.

The system can also incorporate a switching arrangement whereby an individual and/or a sub-group and/or the entire group can be addressed so the instructor can give instructions to whichever individual he selects, to whichever of a number of pre-selected sub-groups he choses and/or the entire group. It would of course be possible to arrange for a plurality of individuals to be instructed without the need for determining in advance which sub-group they belonged to.

The receiving unit has to include an audio-transducer to produce the sound. This audio-transducer can be in the form of ear-piece to be received in the instructee's ear; this has an advantage in that the power demanded from the unit is low but it is difficult to render such a transducer water-proof in a swimming environment. It is preferred in a swimming environment to use a transducer which is enclosed in a water-tight case and then to incorporate that case in the latex of a swimming cap, which in the case of a swimmer or diver would be the said something worn. In a non-watery environment, the said something could be in the form of a head-piece with ear-pieces to fit in the ears although there is nothing to prevent said something being anything worn or carried by the instructee.

Instead of instructions going direct from the instruction unit which can be a hand-held unit, it would be possible to use a relay unit to augment the signal and the relay unit can derive power from a mains supply.

In another aspect of the invention, a swimming cap has provision for receiving an electronic signal receiving unit.

Said provision can be in the form of a pocket or pockets into which the unit can be inserted.

A further aspect of the invention provides a swimming cap incorporating an electronic signal receiving device. The cap can incorporate the said receiving unit by being made in a dipping process with the unit being between two skins or by having a patch vulcanised over the unit.

The receiving unit can be made in two parts each fitting over an ear with each part containing an audio-transducer with one in addition having the electronic circuitry and the other a power supply.

Unfortunately it has been found that the power demand of the receiving unit and particularly that of the transducers gives an undesirably short life of the receiving unit when non-rechargeable batteries are used. It has therefore been found desirable to use rechargeable batteries. It has also been found desirable to switch off the unit when not in use. To avoid the need for mechanical switches, the unit can be switched on by an electronic signal and be held on for a determined period. One way of doping this would be for a part of the circuit to sense when a signal was being received and to switch off the remainder of the circuit if the signal was not addressed to it and another would be to switch the circuit on when a signal was applied and then switch it off only after a delay.

A yet further aspect of the invention provides a method of recharging batteries without direct contact by placing the batteries with a charging circuit in an alternating magnetic field with the circuit rectifying an alternating voltage derived from the field and deriving a constant current to recharge the batteries.

It has surprisingly been found that water does not attenuate the radio frequencies used in a prototype sufficiently to prevent the prototype being used in swimming coaching, indeed the prototype was effective in six foot of water that is with a trainee at the bottom of the deep end of a swimming pool which was nominally six foot deep (six foot is over 1.8 meters).

The invention will now be described, by way of example, with reference to the accompanying drawings.

BRIEF DESCRIPTION OF THE DRAWINGS

FIG. 3 is a perspective view of an instruction unit, FIG. 4 is a circuit diagram of the instruction unit.

DESCRIPTION OF EXEMPLARY EMBODIMENT

Figure 1:
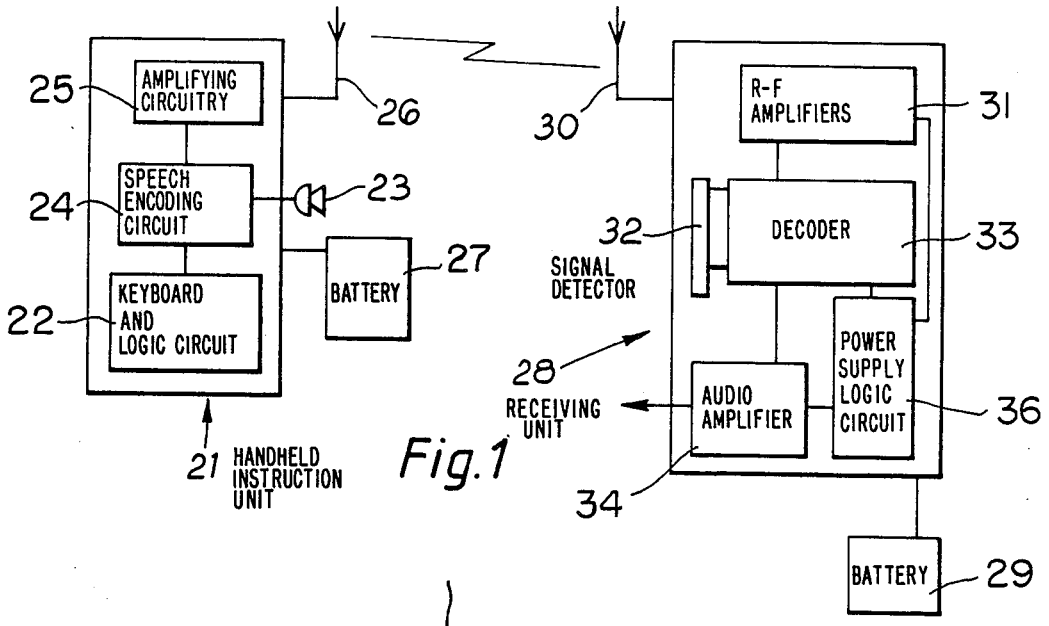
FIG. 1 is a block diagram of a communication system according to the present invention for use in coaching swimmers.

FIG. 1 shows in block outline a communication system. A hand-held instruction unit 21 incorporates a key board and associated logic circuitry 22 which will be mentioned in more detail in relation to FIG. 3, a built-in micro-phone 23, a speech encoding circuit 24, amplifying circuitry 25, and an aerial 26 all powered by a battery 27 or mains electricity, a rechargeable battery is preferred. A receiving unit 28 comprises a battery 29, an antenna 30, radio-frequency amplifying stages 31 possibly in the form of a heterodyne receiver, means 32 for detecting whether the received signal contains a component identifying that the signal is intended for that receiving unit, a decoding arrangement 33, an audio-stage amplifier 34 and a power supply logic circuit 35. The transmission frequency can be of the order of 27 MHz or 49 MHZ but is not critical and the radiated signal has a low power of say 1 watt and is preferably frequency modulated. Depending on the supplier of the transmitters and receiving units, there can be any reasonable number of receiving units associated with one instruction unit. These receiving units would be indentical one with another except for unit-identifying tracks (not shown) which would be processed during manufacture to give a unique identifying code and codes common to a group and to a sub-group, it is theoretically possible to have the said common codes as part of the unique codes (so the unique codes would be ABA, ABB, ABC etc. with the group code A and the sub-group code AB with the receiver sensing the final letter and cutting off the receiver if the final letter is not the right one) and this would economise on tracks.

Figure 2:
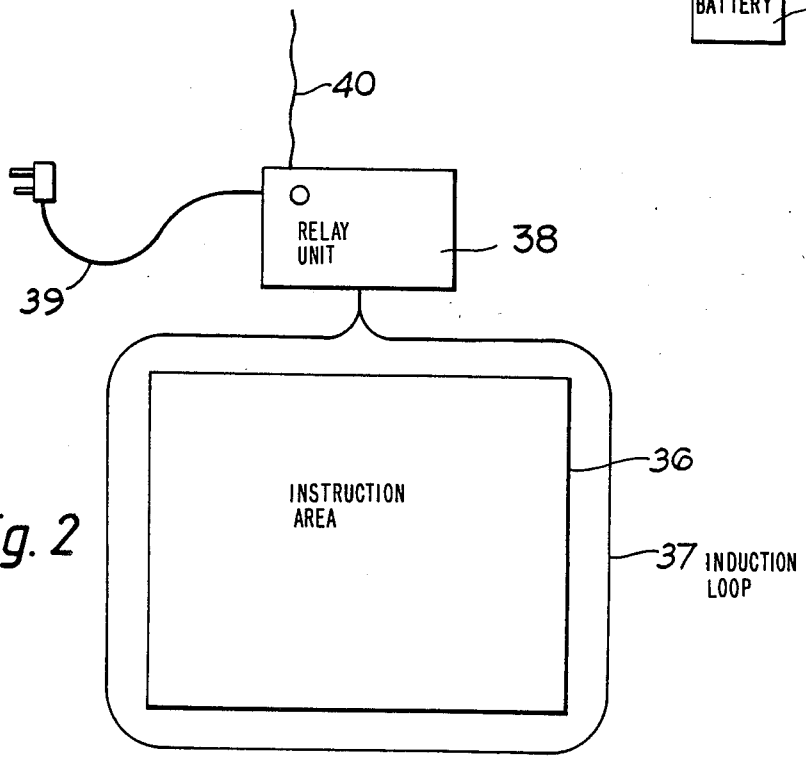
FIG. 2 illustrates a variant.

FIG. 2 illustrates a variant wherein instead of restricting the range by using low power to avoid polluting the magnetic spectrum away from the instruction area, the instruction area 36 is surrounded by an induction loop 37 driven by a relay unit 38 which is mains powered 39 and can receive a signal from the instruction unit 21 by extremely low-power radio transmission or by a cable link 40.

Figure 5:
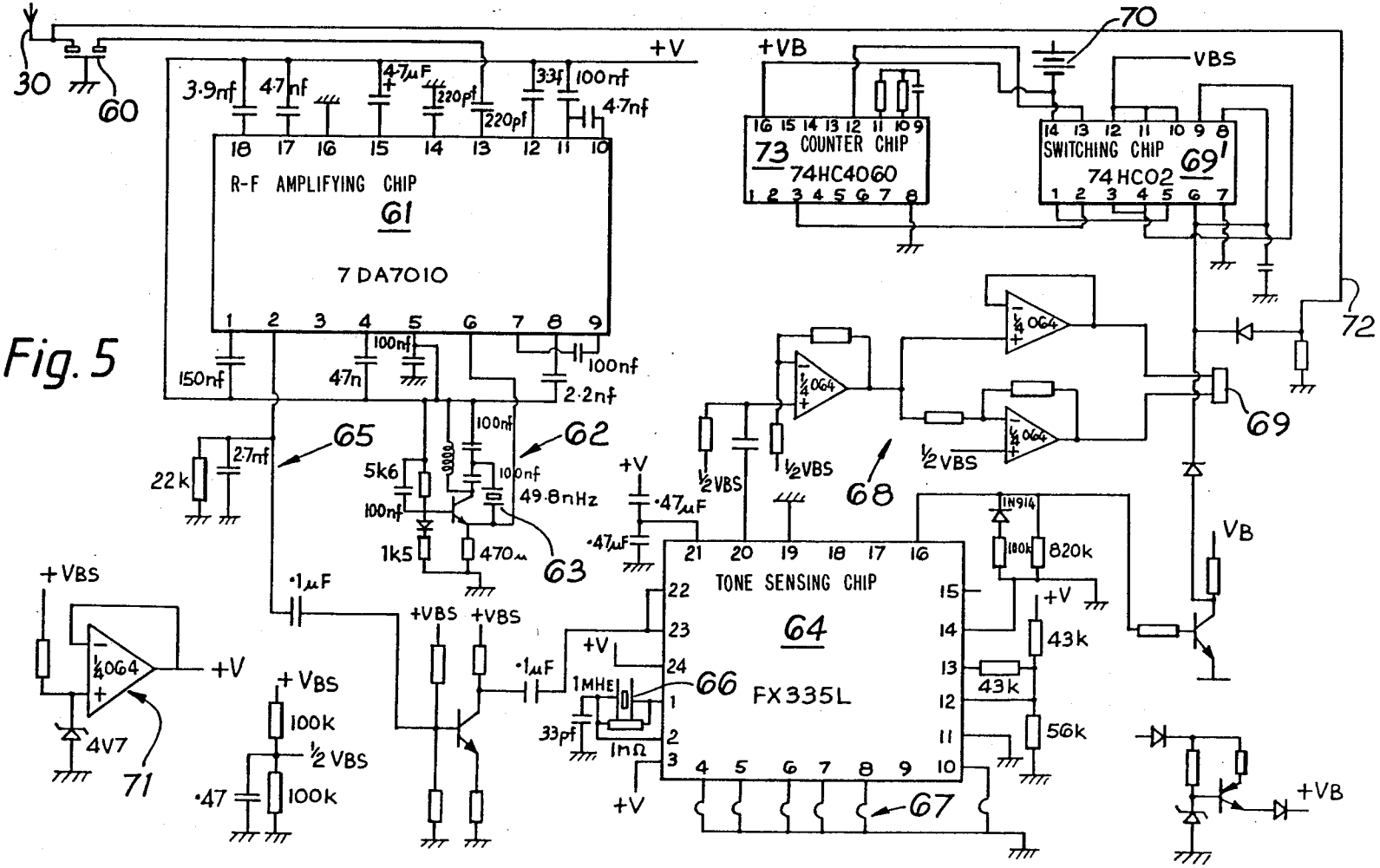
FIG. 5 is a circuit diagram of a receiving unit

FIGS. 3 and 4 illustrate an instruction unit. This instruction unit is contained in a water-tight plastics material case 41 the back of which is adapted to receive notes written on it with say a grease pencil or other marker. The circuit inside the case as shown in FIG. 4 comprises a stop watch chip 42 controlled by an initiating button 43 (FIG. 3) and a stop button 44 (FIG. 3), a display 45 for the stop watch, a microphone 46, and audio amplifier chip 47, a battery 48, an on-off switch 49, a calling tone generator chip 50, an array of addressing buttons some 51 of which are intended to summon an individual and others 52 a group of individuals, these buttons controlling the tone generated, a chip 52' for superimposing the output of the tone generator chip on the output of the audio amplifier, and a radio frequency amplifier chip 53 with its frequency deciding oscillator 54. The precise circuitry and components have not yet been finalised and so it would be misleading to give components and precise circuitry. However the requirements for the stop watch chip are that preferably it is of a type that not only has an initiating and a stop button but also has an arming button 55 permitting the timing to start on a receipt of a large signal on line 56 from the microphone denoting arrival of a loud noise such as a start-race signal. The calling tone generator can be in the form of a micro-processor which could not only synthesise the tones but perhaps could without too much cost allow the buttons 52 to cover variable groups of individuals by a program which included a step that pushing a button 52 followed shortly by pushing buttons 51 meant that that button 52 thereafter meant the pushed buttons 51 and then cycle the tones between the codes for the right buttons 51; the receiver unit presently developed relies on each button 51 or 52 having a distinct tone and so is tuned to two tones or more. The output of the chip 53 is fed through a rubber covered aerial 26. FIG. 5 is a circuit diagram of a receiving unit. Whilst development is not complete and no provision has been made for scrambling the signals as indeed was the case in FIG. 4, development has proceeded far enough to give fuller details. The antenna 30 which can be in the form of a pick-up loop passes the incoming signal through a filter 60 such as a Ceramic Murata SFE49 to a radio-frequency amplifying chip 61 such as a Mulland TDA TO21 with a beat oscillator 62 controller by a 49.80 Megahertz crystal oscillator 63. The output of the chip 61 is fed to a tone sensing chip 64 such as a CML FX335SLVI through a noise eliminating filter 65. With the chip 64 there are associated a frequency-standard oscillator 66 such as a 1 MegaHertz crystal and a succession of breakable links 67 to determine the tones to be sensed. The output of the chip 64 which is the output of the chip 61 only when the correct tone is sensed is fed through amplifier stages 68 to an audio transducer arrangement 69. Another output from the chip 64 is taken to a power switching chip (such as a 74HC02) 69' which receives a voltage from a battery 70 and switches that voltage off or on ('on' means to the rest of the circuitry direct or through a voltage regulator 71). This chip is switched into one state by a signal from the chip 64 or a large signal taken from the antenna 30 on line 72 and this state is the one passing the voltage. This chip 69' is held in that state until the state is reversed by another chip 73 such as a 74HC4060 which is a counter timer setting a delay of say 30 minutes. The signal on the line 72 will only be large if the antenna is very close to the transmitter and so this is used to set the receiver unit functioning at the start of a training session and thereafter this signal will be weak and only the signal from the chip 64 (which has been switched on) will operate the chip 69'.

Figure 6:
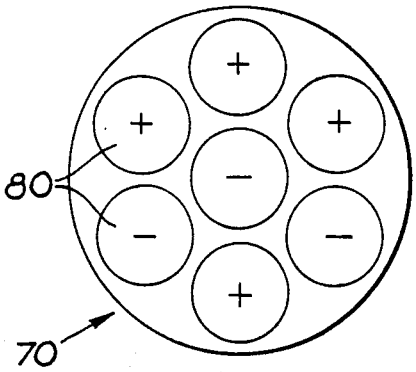
FIG. 6 shows the arrangement of cells forming a battery used in the circuit of FIG. 5.

FIG. 6 shows an arrangement of cells 80 forming the battery 70 of FIG. 5. Seven miniature nickel-cadmium cells packed six around a central one with suitable connections to arrange them in series can provide 8.40 volts with a capacity of 60 milliampere-hours within a diameter of 5 cm. and a depth of 6 mm. even when the cells are encapsulated in a water-proofing plastics material.

Figure 7:
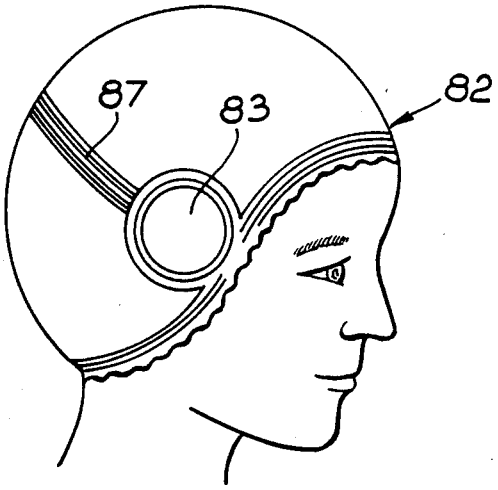
FIG. 7 is a view of a swimmer wearing a cap embodying the present invention.
Figure 8:
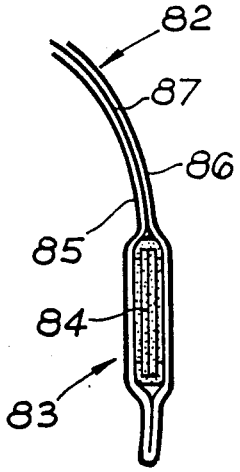
FIG. 8 is a section of a detail on line VIII–VIII of FIG. 7.
Figure 9:
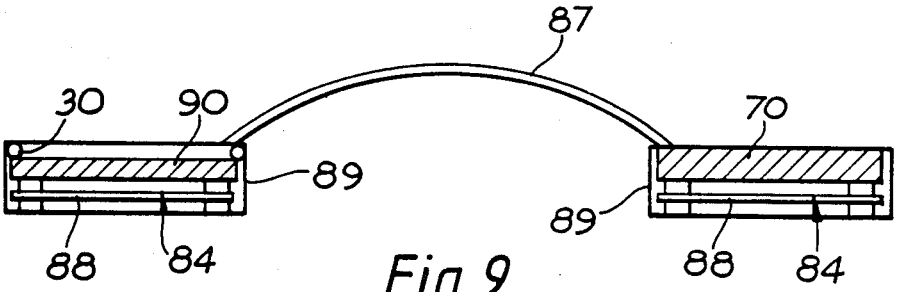
FIG. 9 is a schematic section showing detail of FIG. 8.

FIGS. 7 to 9 illustrate the mechanical arrangement of the receiving unit. FIG. 7 shows a swimmer wearing a bathing cap 82 which has a projection 83 over each ear. FIG. 8 shows that each projection contains a part 84 embodied in the cap as by the parts with a stretchable electric interconnection 87 being attached to a layer 85 formed by a first moulding dip with a second layer 86 being formed over the first layer and the parts and interconnection by a second moulding dip. Each of the parts 84 contains an audio transducer 88 such as of Murata piezoelectric material and forming part of the arrangement 69 with each part being contained in a sealed enslosure 89. The walls of the enclosure are spaced from the transducer on all sides and there is free space behind the transducer to receive in one part the battery 70 and in the other part a printed circuit board 90 mounting the circuitry of FIG. 5 which board is about the same size as the battery (this is facilitated by using surface mounted components), and the antenna 30.

Figure 10:
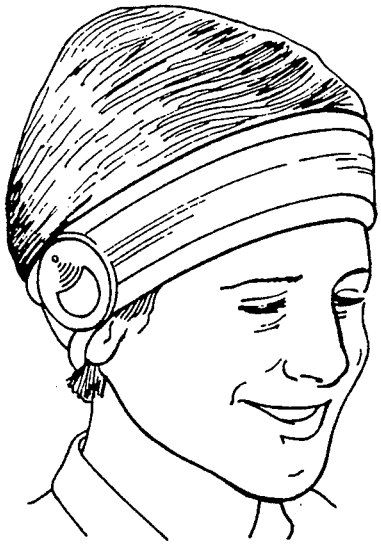
FIG. 10 is a a view of how the receiving unit can be worn for other uses.

FIG. 10 illustrates that the receiving unit can be mounted otherwise than in a swimming cap for other uses. FIG. 10 actually shows the receiving unit in a sweat band for foot sports with the receiving unit being in one or two parts. It is not essential to use rechargeable batteries in uses where water-proofing is not a key issue. In uses demanding head protection, the receiving unit can be incorporated in a helmet.

Figure 11:
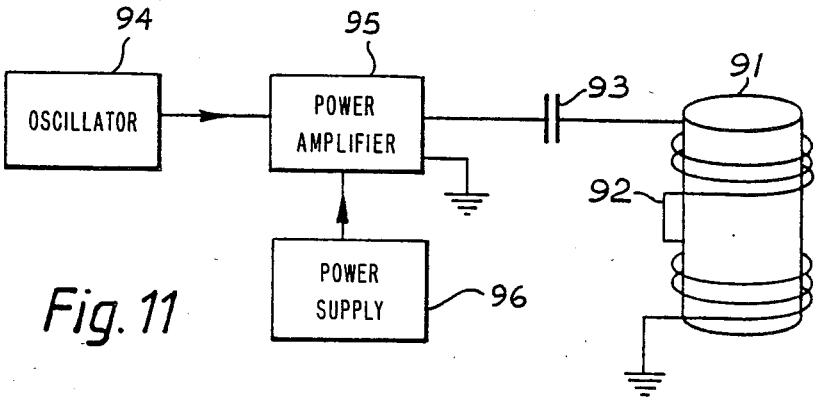
FIG. 11 shows diagrammatically a recharging unit for the battery used in FIG. 5.
Figure 12:
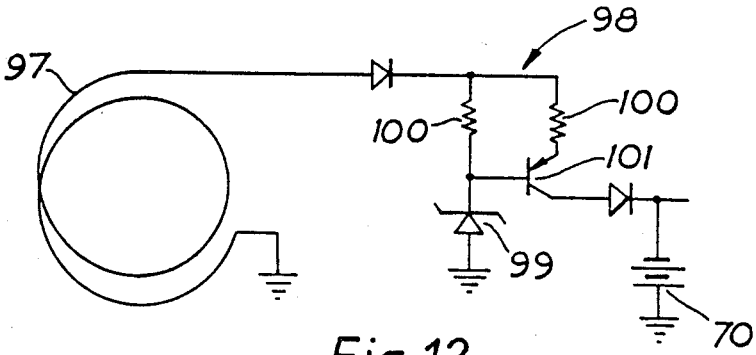
FIG. 12 illustrates how the unit of FIG. 11 co-operates with circuitry connected to the battery to charge the battery.

FIGS. 11 and 12 illustrate a way of recharging the battery 70 without removing, or obtaining direct contact with, it so it can remain sealed within the enclosures for the life of a swimming cap. The caps of several swimmers can be thrown into a non-metallic container 91 surrounded by a coil 92 in series with a capacitor 93, the coil and the capacitor being resonant at a frequency of say 25 kiloHertz. An oscillator 94 resonating at this frequency such as a Levell TH150 DM feeds a power amplifier 95 such as a GA28F Mosfet powered by a power supply unit 96 such as a Farnell LT30.2 which in turn keeps the coil 92 strongly resonating. The resulting magnetic field is picked up by a coil 97 in FIG. 12 which can be the aerial or antenna 30. This coil is then connected to a current regulating device 98 consisting of a reference Zener diode 99, resistors 100 and a transistor 101 to charge the battery at a constant low current. The orientation of the coil 97 does not seem critical within a wide range of orientations.

No provision has been made in the described embodiments for avoiding eaves-dropping but this would seem to be a mere matter of incorporating commercially available scrambling chips in the circuits.

The radio-frequency used depends largely on the licensing authorities allocating frequencies and their restrictions on power outputs at permissible frequencies. Thus in the U.K., theauthorities will only permit minimal power at 49 MHz and so 27 MHz when they will permit 4 watts will be better.

It is possible to use independent receiving units for each ear when it is desired to use two earpieces with each unit being self-contained with its own battery and circuitry. This avoids the need for a stretchable electrical connection which even with connection anchorages may be a source of failure if the wearer uses the projections 83 as an aid in pulling a swimming cap on. It is not thought that the connection would be a source of weakness and it would only be necessary in any event to wind the connection around the enclosure to give a firm anchorage taking any strain off the connection's terminations.

We claim:

1. A communication system for instructing individual members of a group and the group as a whole comprising a transmitter to be used by the instructor and a receiver for each memeber of the group which receiver contains an electric battery and is mounted on an elastically extensible article to be worn on the head of the respective member, each receiver designed to be extensible and to be contained within the extensible article, an input amplifier stabilized by a crystal oscillator and yielding an audio frequency signal, decoding means for sensing a sub-audible tone in that signal identifying that the signal is intended for the entire group or another sub-audible tone identifying that the signal is intended for the particular receiver, an output circuit for passing the signal to audio transducers, one over each ear of the member in use, when the decoding means yields a signal denoting that a sub-audible tone acceptable to that receiver is contained in the audio frequency signal, and in that the transmitter injects a sub-audible continuous tone under the control of the instructer to identify the member to be instructed onto the audio input to the receiver.

2. A communication system according to claim 1 wherein each receiver contains a timing unit which is arranged to operate after a delay to shut off the receiver.

3. A communication system according to claim 1 or claim 2 wherein each receiver's battery consists of at least one rechargeable cell and wherein each receiver contains circuitry for recharging the battery without the battery being removable from the receiver.

* * * * *